US010962918B2

(12) United States Patent
Nakayashiki

(10) Patent No.: US 10,962,918 B2
(45) Date of Patent: Mar. 30, 2021

(54) IMAGE FORMING APPARATUS HAVING A MOUNTABLE UNIT FOR DISCHARGING DEVELOPER

(71) Applicant: CANON KABUSHIKI KAISHA, Tokyo (JP)

(72) Inventor: Yuji Nakayashiki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/895,657

(22) Filed: Jun. 8, 2020

(65) Prior Publication Data

US 2020/0409289 A1 Dec. 31, 2020

(30) Foreign Application Priority Data

Jun. 28, 2019 (JP) ..... JP2019-121496

(51) Int. Cl.
*G03G 21/00* (2006.01)
*G03G 21/10* (2006.01)
*G03G 15/08* (2006.01)

(52) U.S. Cl.
CPC ..... *G03G 21/105* (2013.01); *G03G 15/0891* (2013.01); *G03G 21/0011* (2013.01); *G03G 2221/1624* (2013.01)

(58) Field of Classification Search
CPC .... G03G 21/10; G03G 21/105; G03G 21/185; G03G 2221/1624
USPC ..... 399/358, 360
See application file for complete search history.

(56) References Cited

U.S. PATENT DOCUMENTS 8,873,999 B2 * 10/2014 Sato ..... G03G 21/10 399/120
9,645,544 B2 * 5/2017 Sato ..... G03G 21/1633
9,964,915 B2 * 5/2018 Hashimoto ..... G03G 21/105
10,248,079 B2 * 4/2019 Sato ..... G03G 21/1814
2007/0297840 A1 12/2007 Onodera
2014/0186071 A1 * 7/2014 Sato ..... G03G 15/0194 399/110
2014/0314461 A1 * 10/2014 Ishizuka ..... G03G 15/161 399/358
2015/0078796 A1 3/2015 Sadamitsu
2020/0241462 A1 * 7/2020 Sato ..... G03G 21/1642

FOREIGN PATENT DOCUMENTS

EP 3410225 A1 12/2018
JP 2000276021 A 10/2000
JP 4622353 B2 2/2011
JP 2011107175 A * 6/2011 ..... G03G 21/12

OTHER PUBLICATIONS

Extended European search Report issued in European Appln. No. 20178157.2 dated Nov. 20, 2020.

* cited by examiner

*Primary Examiner* — Robert B Beatty
(74) *Attorney, Agent, or Firm* — Rossi, Kimms & McDowell LLP

(57) ABSTRACT

An image forming apparatus includes a photosensitive unit provided with a discharge opening, a pair of frame members, a developer receiving portion connected to the discharge opening, and a developer feeding portion connected to the developer receiving portion. The developer receiving portion is provided inside a space sandwiched between the frame members. The developer feeding portion is provided outside the space.

14 Claims, 10 Drawing Sheets

IMAGE FORMING APPARATUS HAVING A MOUNTABLE UNIT FOR DISCHARGING DEVELOPER

FIELD OF THE INVENTION AND RELATED ART

The present invention relates to an image forming apparatus, such as a copying machine, a facsimile machine, a printer and a multi-function machine, in which a developer removed from a photosensitive member is discharged and collected.

Conventionally, in an image forming apparatus using the developer, a technique in which the developer generating during image formation is collected to in a collecting container and the collecting container is periodically exchanged has been known (Japanese patent No. 4622353).

In this technique, on a drawer provided so as to be pullable from an image forming apparatus main assembly, an image forming unit is mounted, and the drawer on which the image forming unit is mounted is pushed in the image forming apparatus main assembly, so that the image forming unit is mounted in the image forming apparatus. This image forming unit includes a feeding member for feeding the developer in the image forming unit removed by a cleaner portion provided in the image forming unit. Further, the image forming unit includes a cylindrical member provided with a discharge opening, for permitting discharge of the developer, provided on a downstream side with respect to a developer feeding direction. Then, the drawer is pushed into the image forming apparatus main assembly, so that the cylindrical member of the image forming unit mounted on the drawer is inserted into a through hole provided in a frame member of the image forming apparatus main assembly and thus is inserted into an insertion opening of the developer collecting container provided outside the frame member of the image forming apparatus main assembly. By this, the developer in the image forming unit is discharged through the discharge opening, so that it becomes possible to collect the developer in the developer collecting container.

Incidentally, in a recent image forming apparatus, in addition to the developer collecting container, consumable component parts such as a photosensitive drum and a developing device are assembled into a unit capable of being easily exchanged by a user, and thus a type in which a lifetime of entirety of the image forming apparatus is extended has been employed.

However, in the above-described conventional example, a constitution in which the developer is discharged in a state in which the cylindrical member provided with the discharge opening through which the developer in the image forming unit is discharged is inserted in the developer collecting container is employed, and therefore, there is a need to project the cylindrical member provided with the discharge opening in a certain length or more.

In the case of a constitution including the exchangeable unit provided with the discharge opening, correspondingly to an amount of projection of the cylindrical member provided with the discharge opening from a main assembly of the image forming unit, the unit and by extension to the image forming apparatus are upsized. There arose such a problem.

SUMMARY OF THE INVENTION

A principal object of the present invention is to provide an image forming apparatus capable of downsizing a unit in the image forming apparatus in which a developer discharged from the unit which is mountable and dismountable is collected.

According to an aspect of the present invention, there is provided an image forming apparatus comprising: a photosensitive unit including a photosensitive member, cleaning means configured to remove a developer from the photosensitive member, and a discharge opening configured to permit discharge of the developer removed from the photosensitive member, the photosensitive unit being mountable in and dismountable from the image forming apparatus; a pair of frame members provided opposed to each other through a space in which the photosensitive unit is mounted; a developer receiving portion connected to the discharge opening of the photosensitive unit and configured to receive the developer discharged through the discharge opening; and a developer feeding portion connected to the developer receiving portion and configured to feed the developer received from the developer receiving portion, to a developer accommodating portion, wherein the developer receiving portion is provided inside the space sandwiched between the frame members, and wherein the developer feeding portion is provided outside the space.

Further features of the present invention will become apparent from the following description of exemplary embodiments with reference to the attached drawings.

DESCRIPTION OF EMBODIMENTS

Embodiments of the present invention will be specifically described with reference to the drawings. Dimensions, materials, shapes and relative arrangement of constituent elements described in the following embodiments should be appropriately be changed depending on structures and various conditions of apparatus to which the present invention is applied, and the scope of the present invention is not intended to be limited thereto.

First Embodiment

Figure 2:
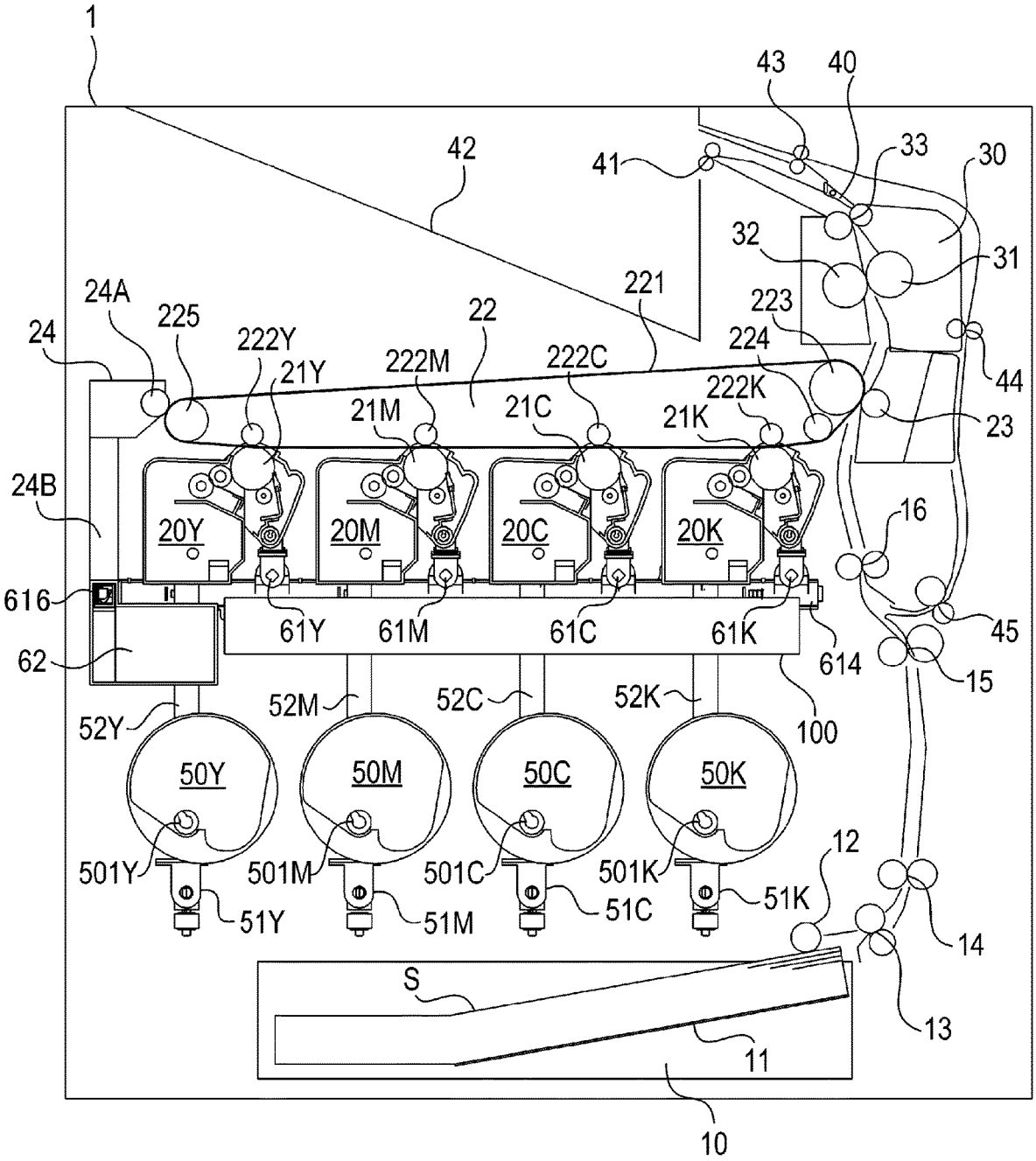
FIG. 2 is a sectional view showing a general structure of entirety of the image forming apparatus according to the first embodiment.

A general structure of the image forming apparatus will be described by using FIG. 2. FIG. 2 is a sectional view showing an outline of entirety of the image forming apparatus according to the first embodiment. In this embodiment, a color laser printer is used as an example of the image forming apparatus.

(Transfer(-Receiving) Material Feeding Portion)

At a lower portion of an image forming apparatus 1, a feeding cassette 10 capable of stacking and accommodating a transfer material is accommodated so as to be pullable. At a downstream-side end portion of the feeding cassette 10 with respect to a transfer material feeding direction, a pick-up roller 12 is provided. In the feeding cassette 10, an intermediary plate 11 for raising an end of the transfer material toward the pick-up roller 12 is provided. A transfer material bundle S including a plurality of transfer materials stacked on the intermediary plate 11 is raised to a position where a surface of an uppermost transfer material thereof is contacted to the pick-up roller 12 with a predetermined pressure. Leading ends of several transfer materials positioned at an upper portion of the transfer material bundle S are sent to a separation roller pair 13 by a rotation operation of the pick-up roller 12. The separation roller pair 13 separates the transfer materials one by one and feeds a registration roller pair 16 via a feeding roller pair 14 and 15 positioned downstream of the registration roller pair 16 with respect to the feeding direction. An unshown feeding sensor is provided downstream of the registration roller pair 16, and detects whether or not a leading end or a trailing end of the transfer material reaches a predetermined position.

(Image Forming Portion)

The image forming apparatus 1 includes four process cartridges 20 (20Y, 20M, 20C, 20K) corresponding to colors of yellow, magenta, cyan and black. Each of the process cartridges 20 (20Y, 20M, 20C, 20K) corresponding to the respective colors is provided so as to be mounted in and dismounted from the image forming apparatus 1 singly. The four process cartridges are different in color of the developers accommodated therein, and the colors thereof are Y (yellow), M (magenta), C (cyan) and K (black) from the left-hand side, but in the case where there is no need to particularly distinct the colors in the following description, symbols Y, M, C and K will be omitted. Further, a scanner unit 100 as an optical scanning portion for forming electrostatic latent images on photosensitive drums 21 (21Y, 21M, 21C, 21K) by irradiating photosensitive drum surfaces with laser beams on the basis of image information is provided at a lower portion of the process cartridges 20. Incidentally, details of the process cartridges 20 will be described later.

(Developer Supplying Container)

Between the scanner unit 100 and the feeding cassette 10, four developer supply containers 50 (50Y, 50M, 50C, 50K) corresponding to the four colors are provided substantially horizontally. The developer supply containers 50 (50Y, 50M, 50C, 50K) are provided below the respective process cartridges 20 with respect to the vertical direction. The developer supply containers 50 (50Y, 50M, 50C, 50K) are developer accommodating portions accommodating developers to be supplied, and supply developers corresponding to the respective colors are filled in the respective developer supply containers. The developer supply containers 50 rotate developer discharging members 501 (501Y, 501M, 501C, 501K) by a driving force from an unshown driving source, and deliver the developers to the developer receiving portions 51 (51Y, 51M, 51C, 51K). The developer receiving portions 51 supply the developers to the process cartridges 20 corresponding to the respective colors via developer feeding portions 52 (52Y, 52M, 52C, 52K).

(Transfer Portion)

At an upper portion of the process cartridges 20, an intermediary transfer unit 22 is provided substantially horizontally. An intermediary transfer belt 221 opposing the respective photosensitive drums 21 is a rotatable endless belt and is stretched by a plurality of stretching rollers 223, 224 and 225. On an inner surface of the intermediary transfer belt 221, primary transfer rollers 222 (222Y, 222M, 222C, 222K) are provided as primary transfer members at positions opposing the photosensitive drums 21 via the intermediary transfer belt 221. By applying a voltage to each of the primary transfer rollers 222, a developer image is transferred from each of the photosensitive drums 21 onto the intermediary transfer belt 221.

In this embodiment, a constitution in which a unit including the intermediary transfer belt 221, the plurality of stretching rollers 223, 224 and 225 for stretching the intermediary transfer belt 221, and the respective primary transfer rollers 222 is used as the intermediary transfer unit 22 and is mountable in and dismountable from the image forming apparatus 1 is employed.

A secondary transfer roller 23 which is a secondary transfer member contacts the intermediary transfer belt 221 and forms a secondary transfer portion in cooperation with the opposite-side stretching roller 223 via the intermediary transfer belt 221. At the secondary transfer portion, the developer image transferred on the intermediary transfer belt 221 is secondary-transferred into the transfer material. The developer remaining on the intermediary transfer belt 221 without being completely transferred onto the transfer material by the secondary transfer is removed by a cleaning unit 24. The cleaning unit 24 is provided with a cleaning roller 24A contacting the intermediary transfer belt 221. The developer removed by the cleaning roller 24A is fed to a developer collecting container 62 through a developer feeding portion 24B and then is accommodated in the developer collecting container 62.

(Fixing Portion)

Thereafter, the transfer material on which the developer image is transferred at the secondary transfer portion is fed to a fixing portion 30 and passes through a fixing nip formed by a heating unit 32 provided inside the fixing portion 30 and a pressing roller 31 press-contacted to the heating unit 32. On a side downstream of the fixing nip, an unshown feeding sensor is provided, and the feeding sensor detects whether or not the leading end or the trailing end of the transfer material reaches a predetermined position. In the neighborhood of an exit of the fixing portion 30, a fixing discharging roller pair 33 is provided and to feeds the transfer material toward a downstream side of the feeding direction.

(Discharging Portion and Re-Feeding Portion)

The transfer material passed through the fixing portion 30 is switched in feeding destination to either one of a discharging roller pair 41 or a switch-back roller pair 43 by a switching member 40 and then is guided. In the case of one-side printing, the transfer material is guided to the discharging roller pair 41 by the switching member 40 and then is discharged onto a transfer material stacking portion 42 by the discharging roller pair 41. In the case of double-side printing, the transfer material is guided to the switch-back roller pair 43 by the switching member 40 and then is fed by the switch-back roller pair 43. Then, by reversing the switch-back roller pair 43 (reverse rotation), a transfer material end portion which was the trailing end of the transfer material is switched to the leading end of the transfer material, and then the transfer material is fed to a double-side feeding passage in a switch-back manner. The transfer material fed to the double-side feeding passage is fed again to the registration roller pair 16 via the feeding roller pair 44 and a re-feeding roller pair 45. The transfer material passed through the re-feeding roller pair 45 and the registration roller pair 16 passes through the secondary transfer portion and the fixing portion 30, so that an image is formed on a second surface (side) of the transfer material similarly as in the case of a first surface (side) of the transfer material. Thereafter, the transfer material on which the images are formed on both the first and second surfaces (sides) is guided to the discharging roller pair 41 by the switching member 40, and then is discharged on the transfer material stacking portion 42 by the discharging roller pair 41.

(Process Cartridge)

Figure 3:
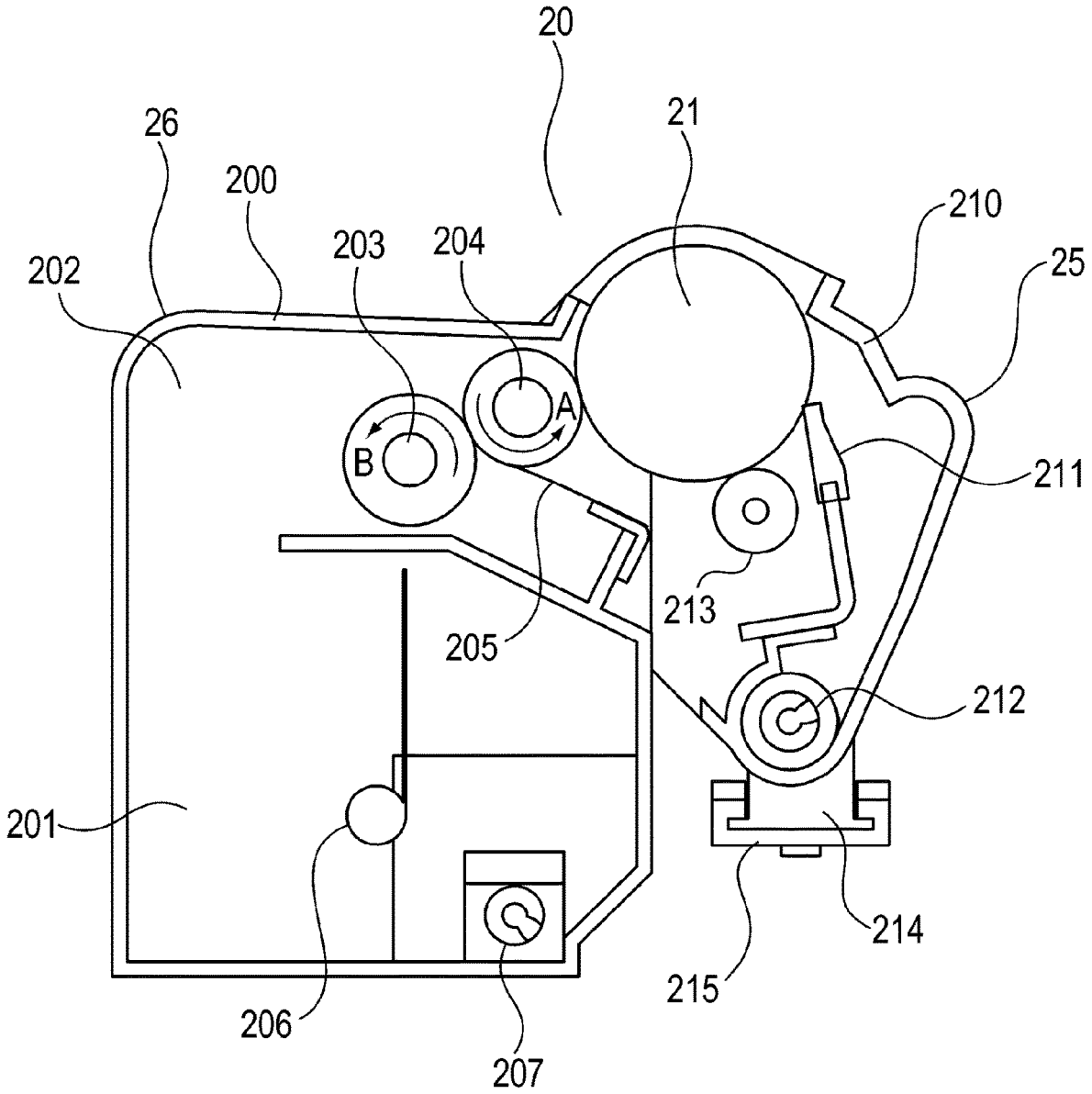
FIG. 3 is a sectional view showing an image forming unit of the image forming apparatus according to the first embodiment.
Figure 4A:
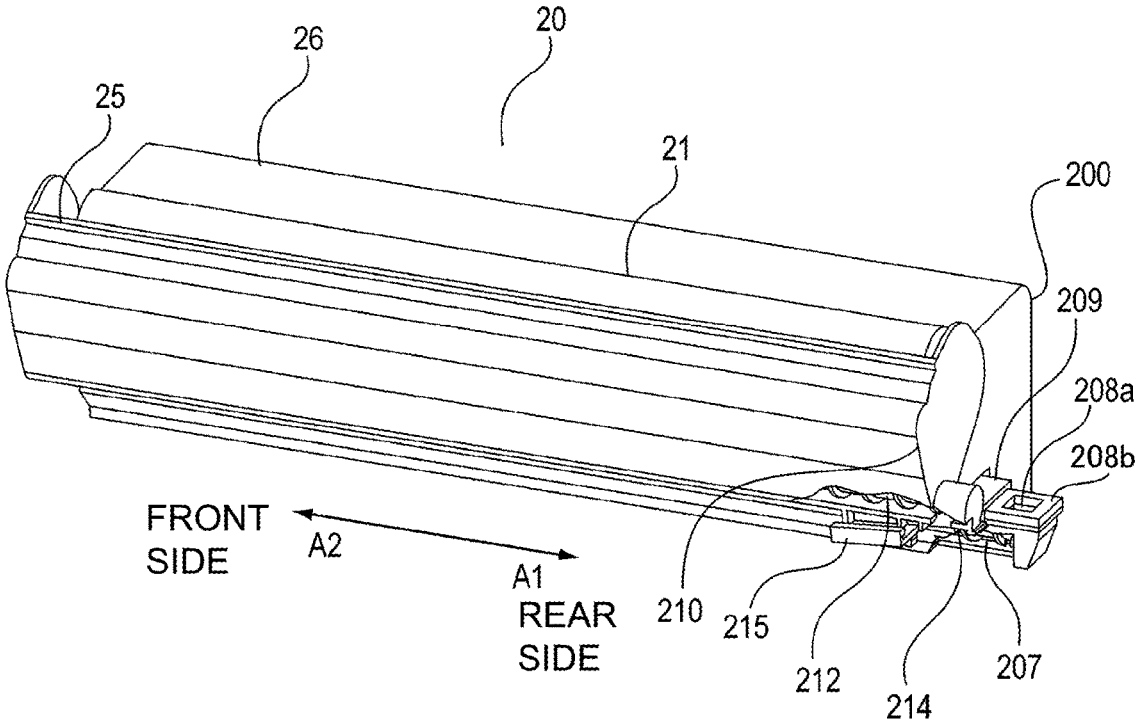
FIGS. 4A and 4B are perspective views showing the image forming unit of the image forming apparatus according to the first embodiment.
Figure 4B:
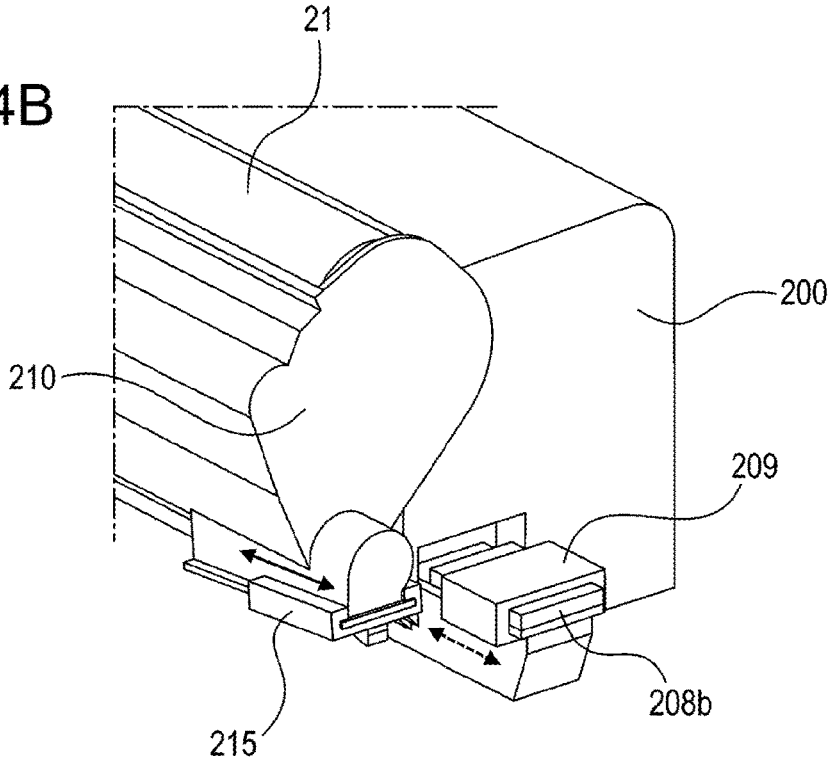

Details of the process cartridge will be described using FIGS. 2 to 4A and 4B. FIG. 3 is sectional view showing a structure of the process cartridge in the first embodiment. FIGS. 4A and 4B are perspective views showing a structure of the process cartridge in the first embodiment, in which FIG. 4A shows a state in which the process cartridge is mounted in the image forming apparatus, and FIG. 4B shows a state in which the process cartridge is dismounted from the image forming apparatus.

As shown in FIG. 3, the process cartridge 20 includes a photosensitive unit 25 constituted so as to support the photosensitive drum 21 and the like by a first frame 210 and a developing portion 26 constituted so as to support a developing roller 204 and the like by a second frame 200. The photosensitive unit 25 and the developing portion 26 are constituted as the process cartridge 20 so as to be integrally mountable and dismountable from the image forming apparatus 1. The process cartridge 20 is mounted in and dismounted from the image forming apparatus in directions (arrow A1 and arrow A2 directions shown in FIG. 4A) of an axis which is a rotation center of the photosensitive drum 21. Incidentally, in FIG. 4A, the arrow A1 direction is a direction in which the process cartridge 20 is mounted in the image forming apparatus, and the arrow A2 direction is a direction in which the process cartridge 20 is pulled out. Further, in the mounting direction (arrow A1 direction) of the process cartridge 20, a downstream side is a rear side of the image forming apparatus, and an upstream side is a front side of the image forming apparatus. That is, the process cartridge 20 is mounted and dismounted in a front-rear direction (arrow A1 and A1 directions shown in FIG. 4A) of the image forming apparatus.

As shown in FIG. 4A, the developing portion 26 is provided with a developer receiving opening 208*a* which is a receiving opening for receiving the developer supplied from the developer supply container 50 which is the developer accommodating portion, and develops the electrostatic latent image formed on the photosensitive drum 21, with the developer. As shown in FIG. 3, in the developing portion 26, the second frame 200 is provided with developing rollers 204 (204Y, 204M, 204C, 204K) capable of being contacted to and separable from the photosensitive drums 21 (21Y, 21M, 21C, 21K), respectively. The developing roller 204 develops the electrostatic latent image into a developer image by depositing the developer on the electrostatic latent image formed on the photosensitive drum 21.

As shown in FIG. 3, the second frame 200 is divided into a receiving-side developer accommodating chamber 201 provided on a lower side and a developing chamber 202 provided on an upper side. In the developing chamber 202, the developing roller 204, a developer supplying roller 203 and a developing blade 205 are provided. The developing roller 204 rotates in an arrow A direction in contact with the photosensitive drum 21. The developer supplying roller 203 rotates in an arrow B direction in contact with the developing roller 204. The developer supplying roller 203 has two functions. One is to peel off the developer of the developing roller 204. The other is to supply the developer to the developing roller 204. The developing blade 205 regulates a layer thickness of the developer on the developing roller 204 in contact with a peripheral surface of the developing roller 204. On the other hand, in the receiving-side developer accommodating chamber 201, the developer supplied from the developer supply container 50 which is the developer accommodating portion is accommodated. The receiving-side developer accommodating chamber 201 is provided with a developer feeding member 206 for feeding accommodated toner to the developing chamber 202. The developer feeding member 206 receives a driving force of an unshown driving motor and rotates in the clockwise direction, so that the toner is fed toward the developing chamber 202.

As shown in FIG. 4A, on a rear-side wall surface of the second frame 200, the developer receiving opening 208*a*, a shutter 209 and a seal 208*b* for filling a gap between the developer receiving opening 208*a* and the shutter 209 are provided. The shutter 209 is held by the second frame 200 so as to be slidable in an arrow direction shown in FIG. 4B by a broken line. When the process cartridge 20 is not mounted in the image forming apparatus 1, the shutter 209 is in a state in which the developer receiving opening 208*a* is closed as shown in FIG. 4B. When the process cartridge 20 is mounted in the image forming apparatus 1, the shutter 209 contacts a projection (not shown) provided inside the image forming apparatus 1, and the shutter 209 moves from a rear side toward a front side, so that the developer receiving opening 208*a* is in an open state (FIG. 4A). Further, on the rear-side wall surface of the second frame 200 is provided with an unshown driving gear, and a developer feeding member 207 is rotated by connecting the driving gear with the developer feeding member 207 which is provided in the receiving-side developer accommodating chamber 201 shown in FIG. 3 and which is made of a resin material having a helical shape.

As shown in FIG. 3, the first frame 210 is provided with the photosensitive drum 21 which is a photosensitive member (image bearing member), a charging device 213 for electrically charging the surface of the photosensitive drum 21 uniformly, and a photosensitive member cleaning blade 211 as a cleaning means for removing the developer remaining on the photosensitive drum 21 after the transfer. The first frame 210 is provided with a developer feeding member 212 which permits discharge of the developer, from the process cartridge 20, removed by the photosensitive member cleaning blade 211 and which is made of a resin material having a helical shape, and is provided with a developer discharge opening 214 and a developer discharge opening shutter 215. The developer which is removed from the photosensitive drum 21 to by the photosensitive member cleaning blade 211 and which is fed by the developer feeding member 212 is discharged through the developer discharge opening 214.

The developer discharge opening shutter 215 is held by the first frame 210 so as to be slidable in an arrow direction shown in FIG. 4B by a solid line. When the process cartridge 20 is not mounted in the image forming apparatus 1, as shown in FIG. 4B, the developer discharge opening shutter 215 is in a state in which the developer discharge opening 214 is closed. When the process cartridge 20 is mounted in the image forming apparatus 1, the developer discharge opening shutter 215 contacts the wall of the developer receiving portion provided inside the image forming apparatus 1, and the developer discharge opening shutter 215 slides (moves) from the rear side toward the front side, so that the developer discharge opening 214 is in an open state (FIG. 4A).

(Developer Feeding Passage)

Figure 5:
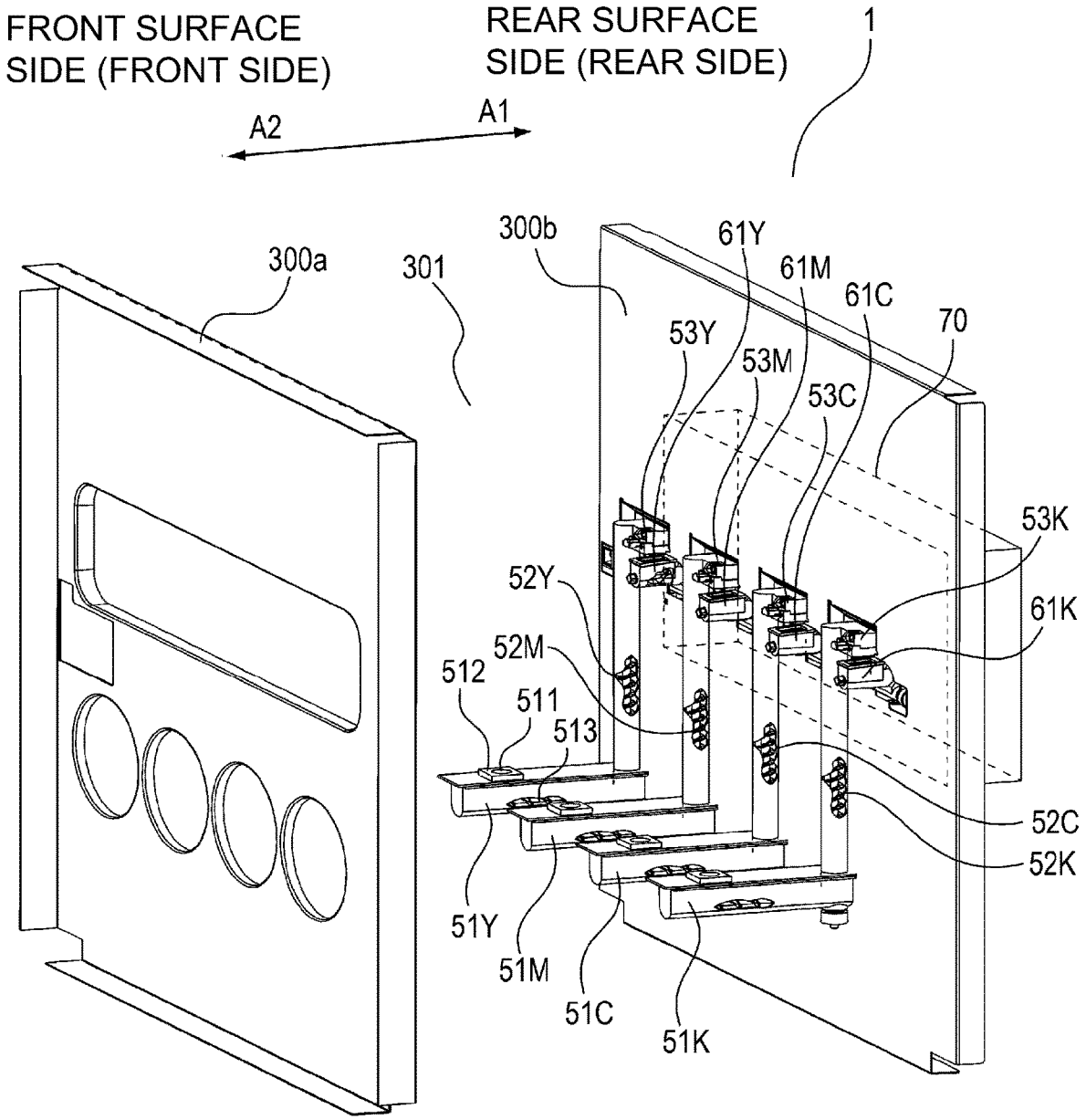
FIG. 5 is a perspective view showing a positional relationship between frame members, a developer supplying passage and a developer collecting passage of the image forming apparatus according to the first embodiment.
Figure 6:
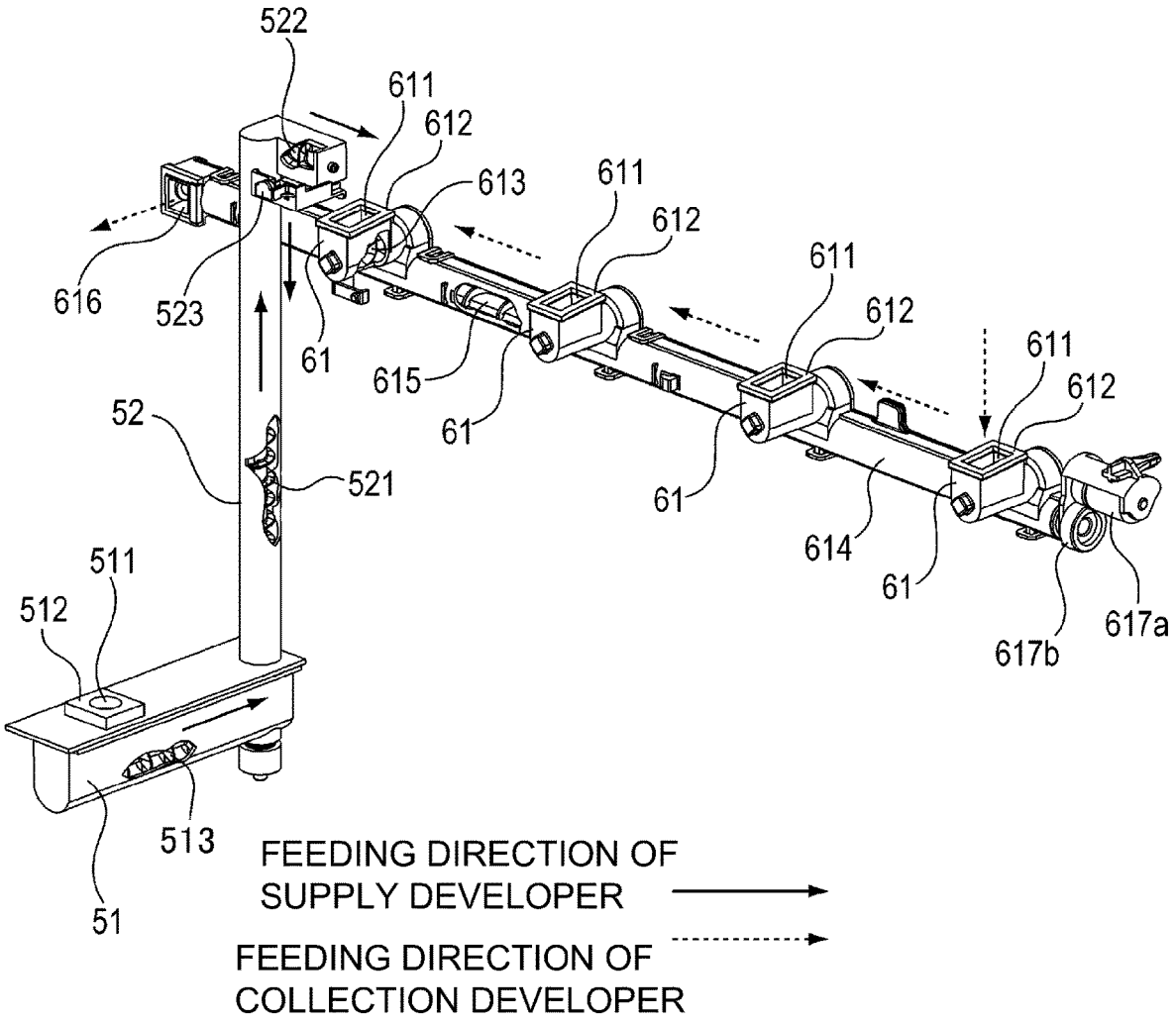
FIG. 6 is a perspective view showing a developer feeding direction of the developer supplying passage and the developer collecting passage of the image forming apparatus according to the first embodiment.

A developer supplying passage and a developer collecting passage which are developer feeding passages provided in the image forming apparatus will be described using FIGS. 5 and 6. FIG. 5 is a perspective view illustrating a positional relationship between frame members, the developer supplying passage and the developer collecting passage of the image forming apparatus in the first embodiment and shows a state in which the process cartridge is dismounted from the image forming apparatus. FIG. 6 is a perspective view illustrating feeding passages of the supply developer and the developer in the image forming apparatus of the first embodiment, and shows a state in which the image forming unit is dismounted from the image forming apparatus. In FIG. 6, arrows of a solid line represent a feeding direction of the developer supplied from the developer supply container toward the process cartridge, and arrows of a broken line represent a feeding direction of the developer collected from the process cartridge into the developer collecting container.

As shown in FIG. 5, the image forming apparatus 1 according to this embodiment includes a pair of frame members 300*a* and 300*b*, developer receiving portions 61 (61Y, 61M, 61C, 61K) and an intermediary developer feeding portion 614 (FIG. 6), constituting the developer collecting passage, and developer receiving portions 51 (51Y, 51M, 51C, 51K), developer feeding portions 52 (52Y, 52M, 52C, 52K), and developer supplying portions 53 (53Y, 53M, 53C, 53K), constituting the developer supplying passage.

As shown in FIG. 5, the pair of frame members 300*a* and 300*b* is provided opposed to each other via a space 301 in which the process cartridge 20 is to be mounted. One frame member 300*a* is disposed on the front side (front surface side) of the image forming apparatus, and the other frame member 300*b* is disposed on the rear side (rear surface side) of the image forming apparatus. The process cartridge 20 is mounted in and dismounted from the space 301 between the pair of frame members 300*a* and 300*b* with respect to the directions (arrow A1 and A2 directions shown in FIG. 5) of the axis which is the rotation center of the photosensitive drum 21. Incidentally, in FIG. 5, the arrow A1 direction is the direction in which the process cartridge 20 is mounted, and the arrow A2 direction is the direction in which the process cartridge 20 is dismounted. Further, with respect to the mounting direction of the process cartridge 20, the downstream side is the rear side (rear surface side) of the image forming apparatus, and the upstream side is the front side (front surface side) of the image forming apparatus.

The front and rear frame members 300*a* and 300*b* have a function of ensuring rigidity of entirety of the image forming apparatus and a function of supporting constituent parts of various functional portions such as the transfer material feeding portion, the fixing portion, the discharging portion and the re-feeding portion which are described above.

Further, the image forming apparatus 1 includes a driving portion 70 for driving feeding members for the developer to be supplied and feeding members for the developer to be collected, which are described later. This driving portion 70 is provided outside the space 301 sandwiched between the pair of frame members 300*a* and 300*b* and is disposed on the rear-side frame member 300*b* of the image forming apparatus 1.

(Developer Supplying Passage)

Here, the developer supplying passage will be described using FIGS. 5 and 6. The developer supplying passage is a feeding passage for supplying the developer from the developer supply container 50 to the developing portion 26 of the process cartridge 20 and is constituted by the developer receiving portion 51, the developer feeding portion 52 and the developer supplying portion 53. In the following, the developer receiving portion 51, the developer feeding portion 52 and the developer supplying portion 53 will be described in the named order.

The developer receiving portion 51 is connected to the developer supply container 50 and receives the developer supplied from the developer supply container 50 when the developer supply container 50 is mounted in the image forming apparatus 1. On a top (upper) surface of the developer receiving portion 51, a developer receiving opening 511 through which the developer supplied from the developer supply container 50 is to be received is formed. At a periphery of the developer receiving opening 511 on the top surface of the developer receiving portion 51, a seal member 512 for filling a gap between itself and the developer supply container 50 is provided. Inside the developer receiving portion 51, a developer feeding member 513 made of a resin material having a helical shape is provided, and feeds the developer toward the developer feeding portion 52 by transmission of a driving force from the driving portion 70 thereto.

The developer feeding portion 52 is connected to the developer receiving portion 51 and feeds the developer received by the developer receiving portion 51, toward the developing portion 26 (FIG. 3) of the process cartridge 20. Inside the developer feeding portion 52, developer feeding members 521 and 522 which are made of a resin material having a helical shape are provided, and feed the developer in arrow directions shown in FIG. 6 by a solid line through transmission of the driving force from the driving portion 70 thereto.

The developer supplying portion 53 is connected to the developer feeding portion 52 and is connected to the developer receiving opening 208*a* (FIG. 4A) which is a receiving opening of the process cartridge 20. The developer supplying portion 53 delivers the developer, fed by the developer feeding portion 52, from an unshown opening of the shutter 523 to the developer receiving opening 208*a* (FIG. 4A) of the process cartridge 20. Thus, the developer is supplied from the developer supply container 50 to the developing portion 26 of the process cartridge 20 by the developer receiving portion 51, the developer feeding portion 52 and the developer supplying portion 53 which constitute the developer supplying passage.

The developer receiving portion 51, the developer feeding portion 52 and the developer supplying portion 53 are disposed in the space sandwiched between the pair of frame members 300*a* and 300*b*. The developer receiving portion 51, the developer feeding portion 52 and the developer supplying portion 53 are provided on the front surface side of the rear surface-side (rear-side) frame member 300*b* of the image forming apparatus 1.

(Developer Collecting Passage)

Figure 1:
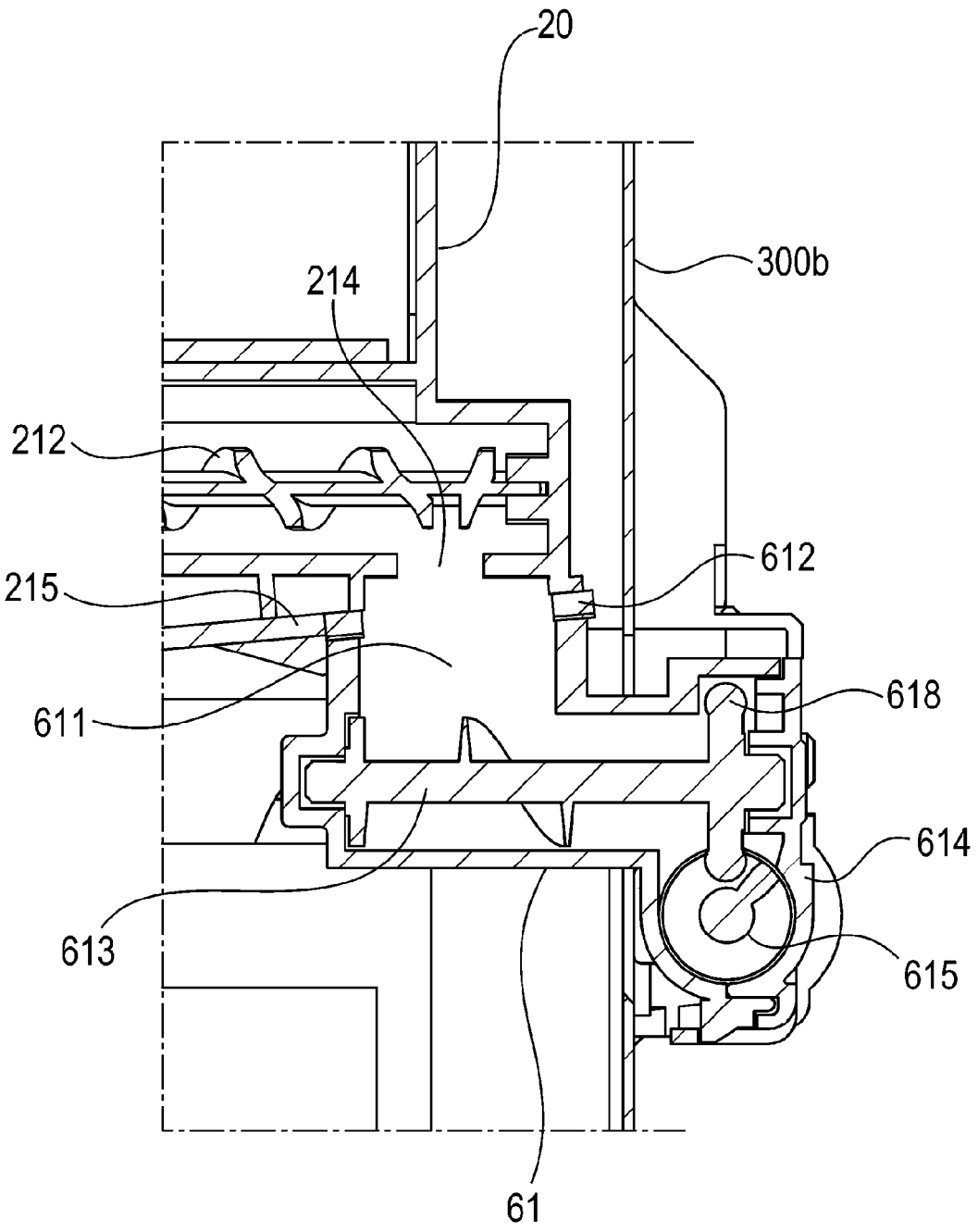
FIG. 1 is a sectional view illustrating a structure of a developer receiving portion of an image forming apparatus according to a first embodiment.

Next, the developer collecting passage will be described using FIGS. 1, 2, 5 and 6. FIG. 1 is a sectional view showing a structure of the developer receiving portion 61 of the image forming apparatus 1 in the first embodiment. The developer collecting passage is a feeding passage from collecting the developer from the process cartridge 20 to the developer collecting container 62 and is constituted by the developer receiving portion 61 and the intermediary developer feeding portion 614.

As shown in FIGS. 1 and 5, the developer receiving portion 61 is connected to the process cartridge 20 and receives the developer discharged from the process cartridge 20 when the process cartridge 20 is mounted in the image forming apparatus 1. The developer receiving portion 61 includes a developer receiving opening 611 for receiving the developer discharged from the process cartridge 20 and a developer feeding member 613 for feeding the received developer.

As shown in FIGS. 1 and 6, the developer receiving opening 611 is connected to the developer discharge opening 214 provided in the first frame 210 (FIG. 3) of the process cartridge 20 and receives the developer discharged through the developer discharge opening 214. At a periphery of the developer receiving opening 611, a seal member 612 for filling a gap between itself and the process cartridge 20 is provided. The developer feeding member 613 is made of a resin material having a helical shape and is provided rotatably inside the developer receiving portion 61. The developer feeding member 613 feeds the developer to the intermediary developer feeding portion 614 provided on the downstream side of the developer feeding direction by rotation thereof.

As shown in FIG. 1, a part of the developer receiving opening 611 of the developer receiving portion 61 and a part of the developer feeding member 613 are disposed inside the space 301 (FIG. 5) sandwiched between the pair of frame members 300*a* and 300*b*. On the other hand, the intermediary developer feeding portion 614 and the developer collecting container 62 (FIG. 2) are disposed outside the space 301 sandwiched between the pair of frame members 300*a* and 300*b* so as to be mountable and dismountable. That is, the developer receiving portion 61 is provided on the front surface side of the rear surface-side (rear-side) frame member 300*b* of the image forming apparatus 1 and has a constitution in which the developer receiving portion 61 is connected to the intermediary developer feeding portion 614 provided on the rear side of the frame member 300*b*. Specifically, a constitution in which the developer receiving portion 61 is disposed on the front side of the rear-side frame member 300*b* and is connected to the intermediary developer feeding portion 614 by penetrating through a through hole of the frame member 300*b* is employed.

The developer feeding member 613 is supported inside the space 301 (FIG. 5) sandwiched between the frame members 300*a* and 300*b* at one end portion thereof in the developer receiving portion 61 and is supported outside the space 301 at the other end portion thereof. The developer feeding member 613 is positioned below the developer receiving opening 611 on one end portion side which is a part thereof and is disposed together with the developer receiving opening 611 inside the space 301. On the other hand, the other end portion side of the developer feeding member 613 passes through the frame member 300*b* and is disposed outside the space 301. Accordingly, the developer discharged through the developer discharge opening 214 of the process cartridge 20 is received by the developer receiving portion 61 through the developer receiving opening 611 on the inside of the space 301. The received developer drops on the developer feeding member 613 disposed inside the space 301. The dropped developer is fed form the inside to the outside of the space 301 by rotation of the developer feeding member 613.

Further, the developer feeding member 613 is provided with a driving force receiving portion 618 for receiving a driving force from the intermediary developer feeding portion 614. When an intermediary developer feeding member 615 is rotated by receiving the driving force from the driving portion 70, the driving force receiving portion 618 is pushed by the intermediary developer feeding member 615, so that the developer feeding member 613 is rotated and feeds the developer.

Further, as shown in FIG. 1, the intermediary developer feeding portion 614 provided on the rear surface side of the frame member 300*b* and disposed outside the space 301 is connected to the downstream side of the developer receiving portion 61 with respect to the developer feeding direction. In this embodiment, as shown in FIG. 6, the plurality of developer receiving portions 61 (61Y, 61M, 61C, 61K) corresponding to the plurality of process cartridges are provided and are connected to a single intermediary developer feeding portion 614.

The intermediary developer feeding portion 614 includes the intermediary developer feeding member 615 and feeds the developer, received by the developer receiving portion 61, toward the developer collecting container 62 (FIG. 2) which is the developer accommodating portion. As shown in FIGS. 1 and 6, the intermediary developer feeding member 615 is a feeding member made of a resin material having a helical shape and is provided rotatably in the intermediary developer feeding portion 614, and feeds the developer toward a further downstream side (arrow direction of a broken line in FIG. 6) in the developer feeding direction. The intermediary developer feeding member 615 is connected to a driving gear 617*b* and is rotated by the receiving the driving force from the driving portion 70 via the driving gear 617*a*, so that the developer is fed.

On a downstream side of the intermediary developer feeding portion 614 with respect to the developer feeding direction, a developer discharge opening 616 is formed. The developer discharge opening 616 is connected to the developer collecting container 62 (FIG. 2), so that the developer discharged through the developer discharge opening 616 is collected in the developer collecting container 62.

As described above, according to this embodiment, the developer receiving portion 61 for receiving the developer discharged from the process cartridge 20 is disposed inside the space 301 sandwiched between the pair of frame members 300*a* and 300*b*. On the other hand, the intermediary developer feeding portion 614 connected to the developer receiving portion 61 is disposed outside the space 301 sandwiched between the pair of frame members 300*a* and 300*b*. That is, a constitution in which the developer receiving portion 61 is provided on the front surface side of the rear surface-side (rear-side) frame member 300*b* of the image forming apparatus 1 and penetrates through the through hole of the frame member 300*b*, and is connected to the intermediary developer feeding portion 614 provided on the rear surface side of the frame member 300*b* is employed.

By employing such a constitution, it becomes possible to suppress elongation of the developer discharge opening 214 in length corresponding to a length of projection thereof from a main assembly of the process cartridge 20, so that the process cartridge 20 can be downsized.

Further, by suppressing the length of projection of the developer discharge opening 214 from the main assembly of the process cartridge 20, it becomes possible to suppress interference with the developer feeding portion 52 disposed inside the space 301 sandwiched between the pair of frame members 300*a* and 300*b*. By this, it becomes possible to shorten a distance between the pair of frame members opposing each other via the space 301 in which the process cartridge 20 is mounted, so that the image forming apparatus can be to downsized. Further, the pair of frame members 300*a* and 300*b* has a function of supporting constituent parts of various functional portions such as the transfer material feeding portions, the fixing portion, the discharging portion and the re-feeding portion, and therefore the inside constituent parts supported by the pair of frame members 300*a* and 300*b* can be downsized.

Further, the developer feeding portion 52, the developer receiving portion 61 and the intermediary developer feeding portion 614 can be held and positioned directly and at closed position on the frame member 300*b* with certain rigidity. For that reason, it becomes possible to ensure a stable position also against impact during transportation and vibration during operation.

Second Embodiment

Figure 7:
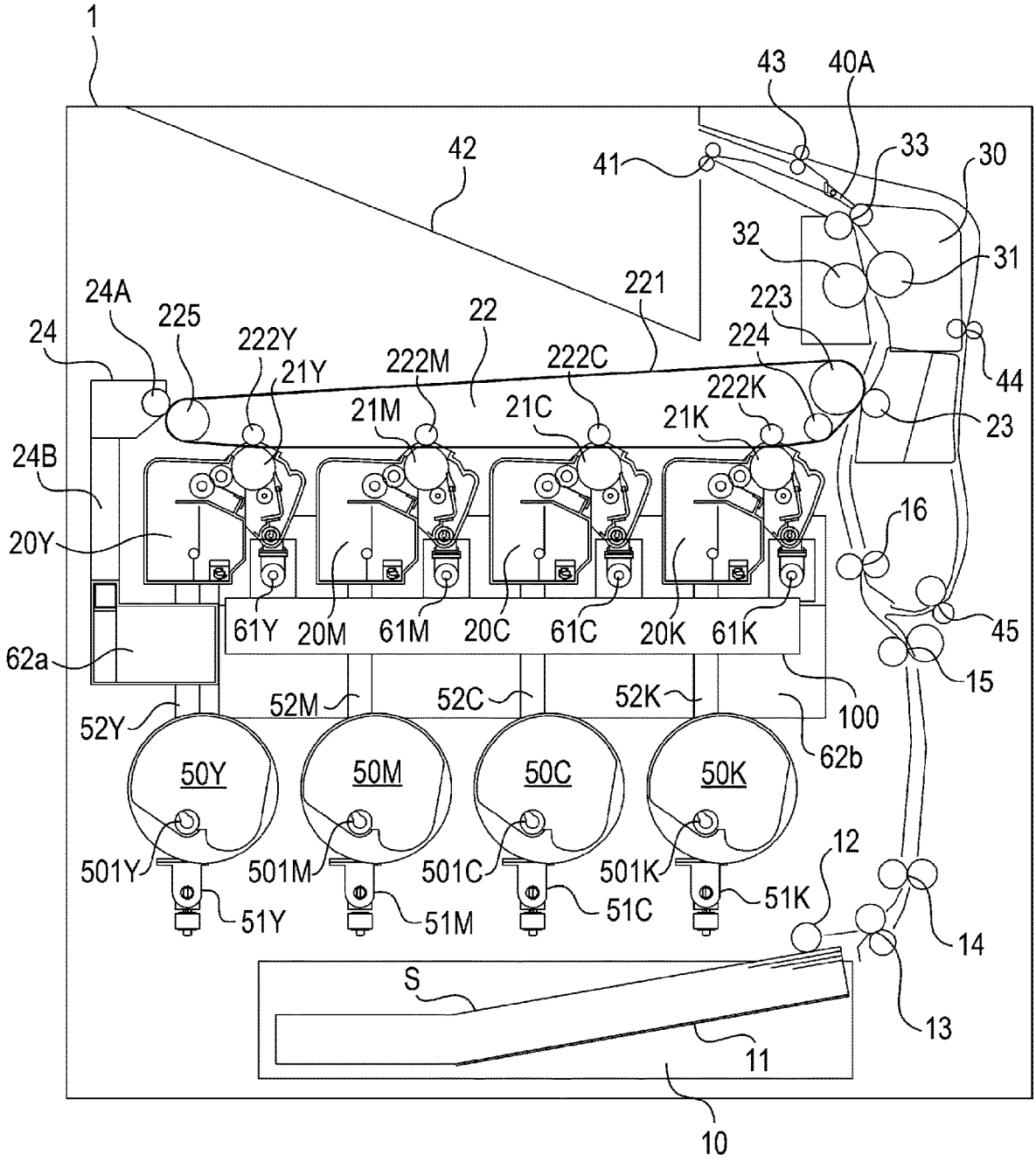
FIG. 7 is a sectional view showing a general structure of entirety of an image forming apparatus according to a second embodiment.
Figure 8:
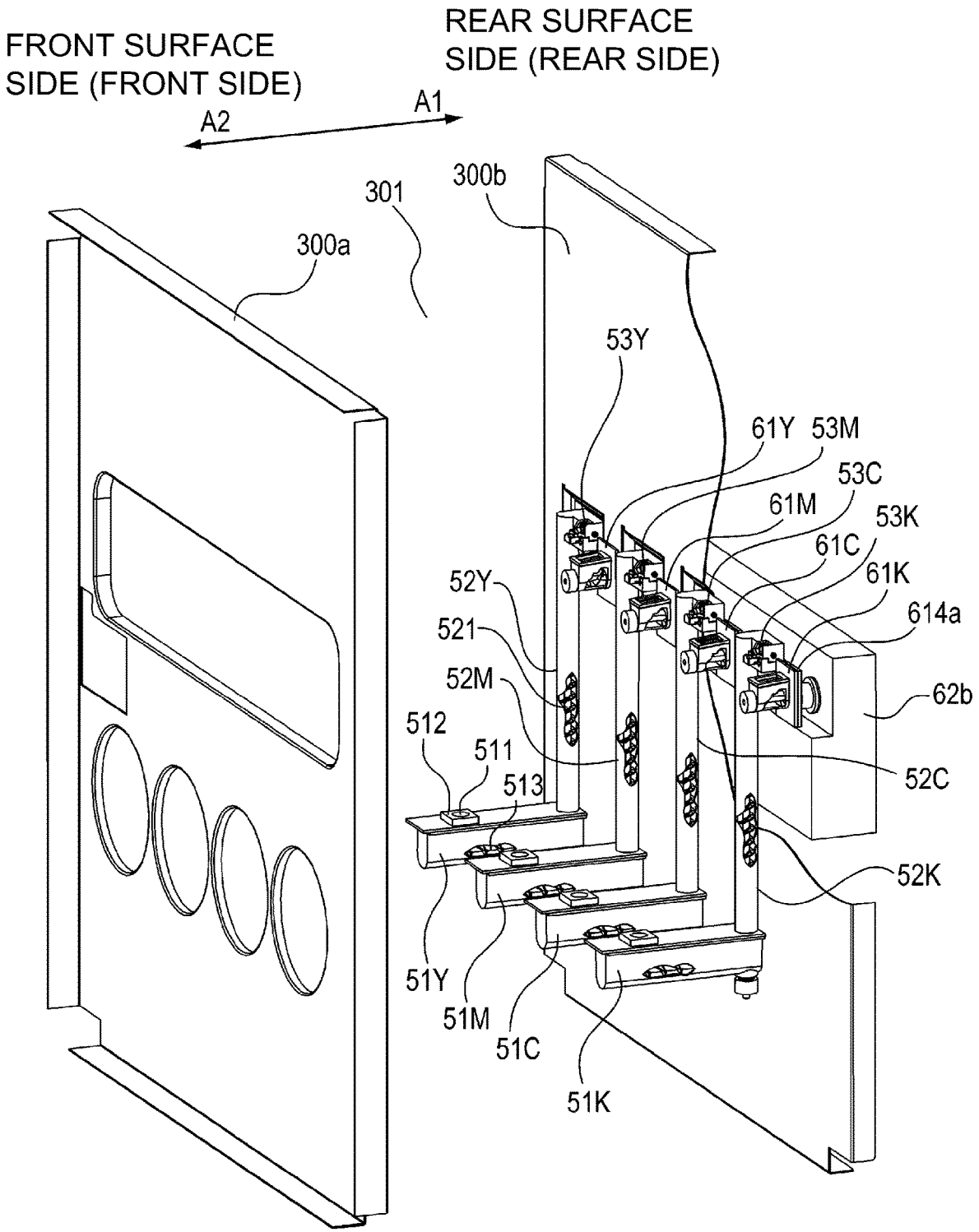
FIG. 8 is a perspective view showing a positional relationship between frame members, a developer supplying passage and a developer collecting passage of the image forming apparatus according to the second embodiment.

An image forming apparatus according to a second embodiment will be described with reference to FIGS. 7 to 10. FIG. 7 is a sectional view showing an outline of entirety of the image forming apparatus according to the second embodiment. FIG. 8 is a perspective view illustrating a positional relationship between frame members, a developer supplying passage and a developer collecting passage and shows a state in which a process cartridge is dismounted from the image forming apparatus. In this embodiment, a color laser printer is illustrated as the image forming apparatus.

Incidentally, in the image forming apparatus according to this embodiment, as shown in FIG. 7, separately from a first developer collecting container 62*a* for collecting a developer removed from an intermediary transfer belt 221, a second developer collecting container 62*b* for collecting the developer removed from a photosensitive drum 21 is provided. Portions other than this point are substantially the same as those in the first embodiment, and therefore, only a point different from the first embodiment will be described. Incidentally, portions similar to those in the first embodiment are represented by the same reference numerals or symbols and will be omitted from description.

As shown in FIG. 8, an, image forming apparatus 1 according to this embodiment includes the pair of frame members 300*a* and 300*b*, the developer receiving portion 61, the second developer collecting container 62*b*, the developer receiving portion 51, the developer feeding portion 52 and the developer supplying portion 53. In the first embodiment described above, a constitution in which the developer received through the developer receiving opening 611 is fed by the intermediary developer feeding portion and is collected in the developer collecting container was described as an example. On the other hand, in this embodiment, a constitution in which the developer received through the developer receiving opening 611 is collected in the second developer collecting container 62*b* is employed.

In this embodiment, as shown in FIG. 8, the developer receiving opening 611 of the developer receiving portion 61 is disposed in the space sandwiched between the pair of frame members 300*a* and 300*b*. On the other hand, the second developer collecting container 62*b* is disposed outside the space 301 sandwiched between the pair of frame members 300*a* and 300*b* so as to be mountable and dismountable. That is, a constitution in which the developer receiving portion 61 is provided on the front surface side of the rear surface-side (rear-side) frame member 300*b* of the image forming apparatus 1 and is connected to the second developer collecting container 62*b* provided so as to be mountable to and dismountable from the rear surface-side of the rear-side frame member 300*b* of the image forming apparatus 1 is employed. Specifically, a constitution in which the developer receiving portion 61 is provided on the front surface side of the rear-side frame member 300*b* of the image forming apparatus 1 and is connected to the second developer collecting container 62*b* by penetrating through a through hole of the frame member 300*b* is employed.

The developer supplying passage for supplying the developer from the developer supply container to the process cartridge is similar to the developer supplying passage in the first embodiment, and therefore, will be omitted from description in this embodiment.

(Developer Collecting Passage)

Figure 9:
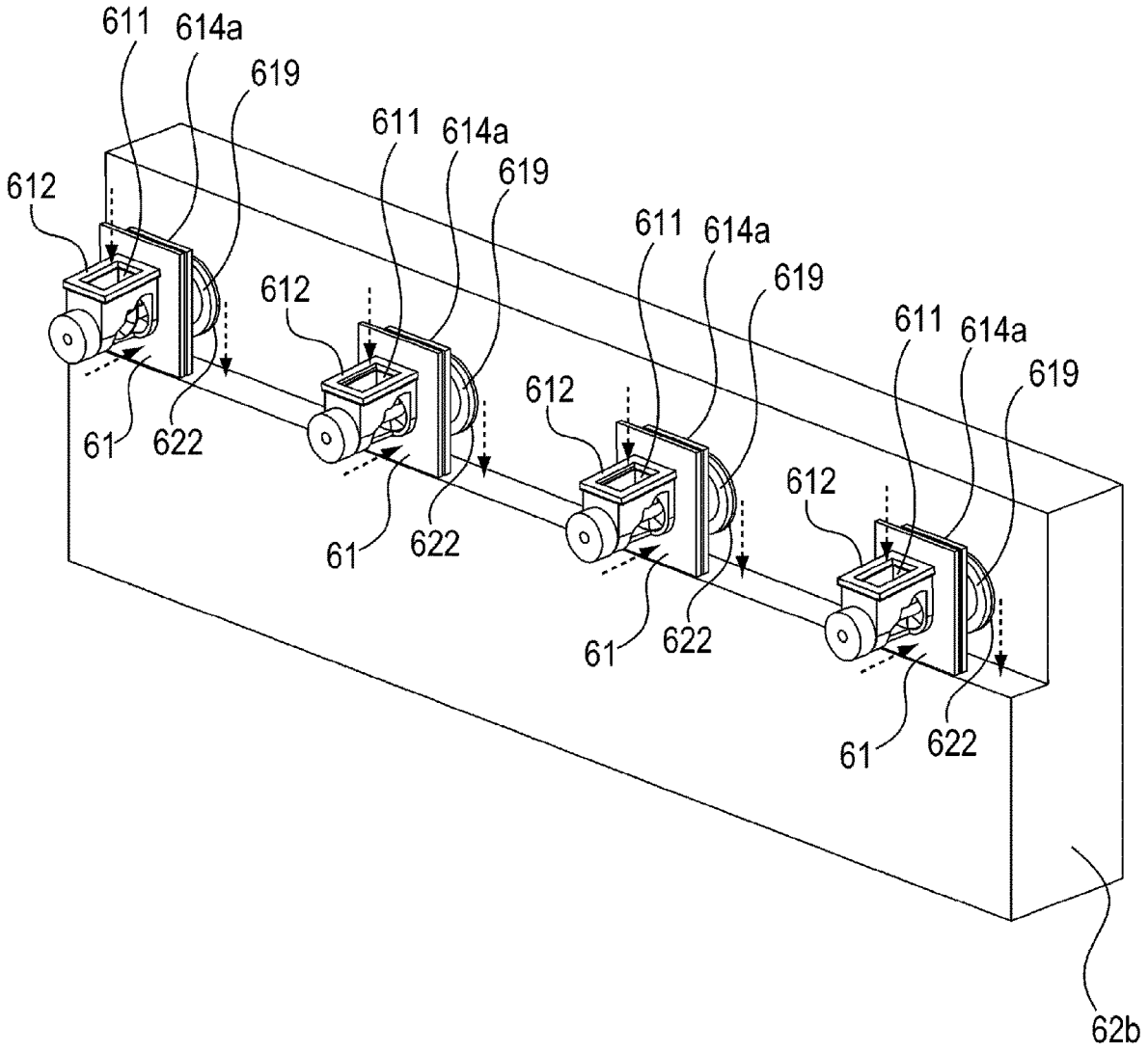
FIG. 9 is a perspective view showing a developer feeding direction of the developer collecting passage of the image forming apparatus according to the second embodiment.
Figure 10A:
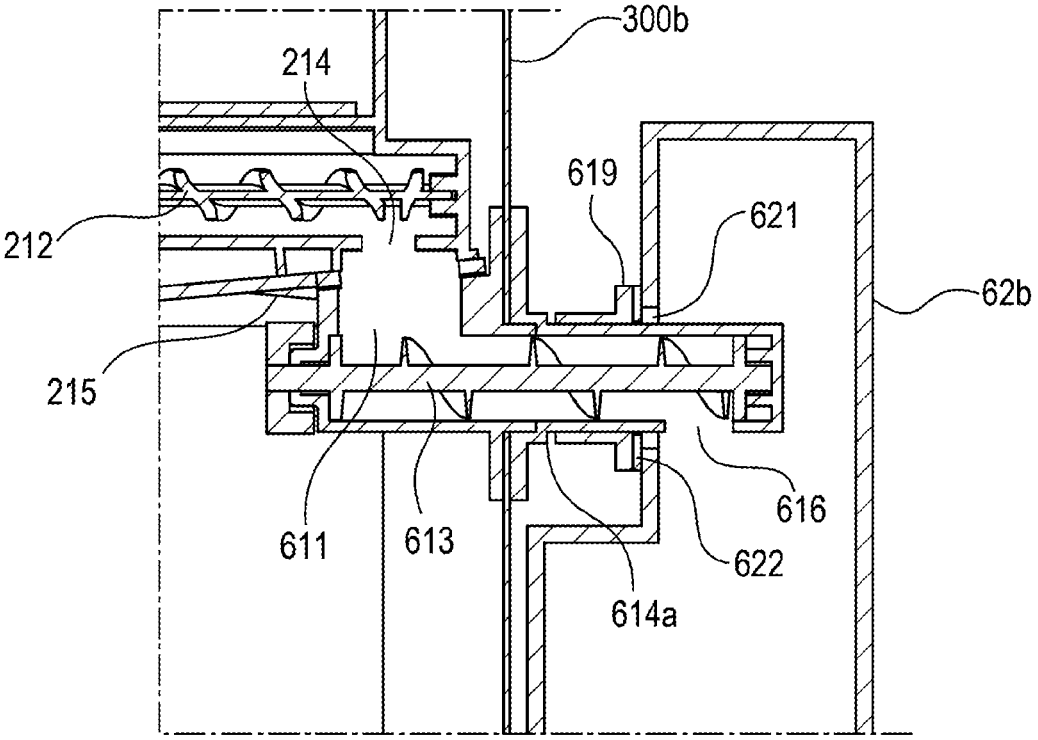
FIGS. 10A and 10B are sectional views showing a structure of a developer receiving portion of the image forming apparatus according to the second embodiment.
Figure 10B:
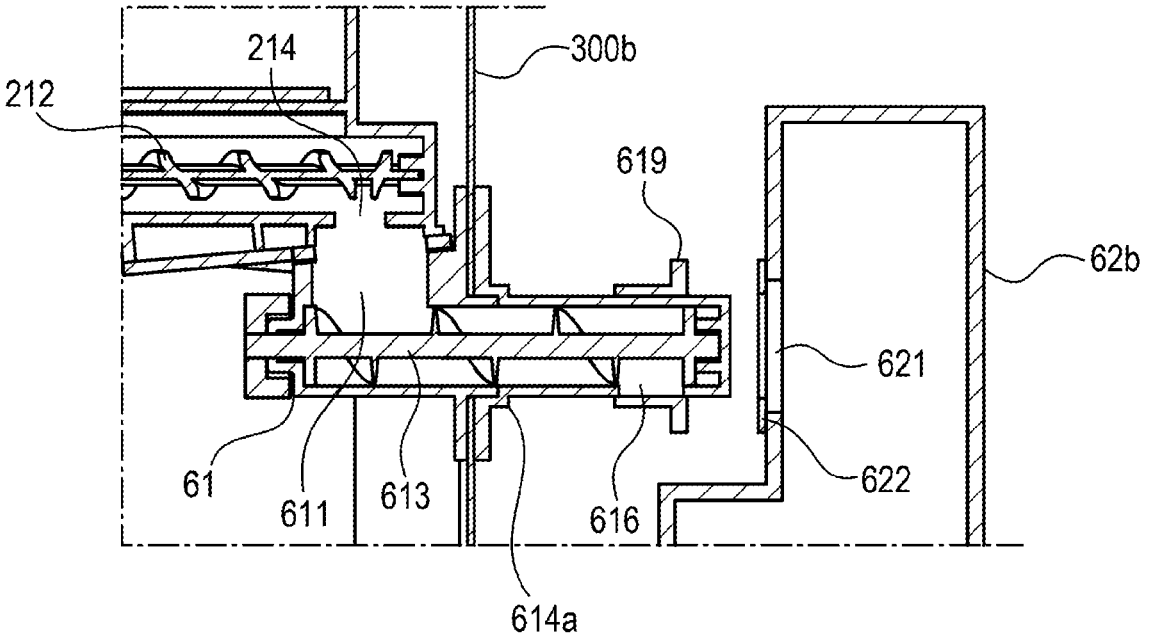

The developer collecting passage will be described using FIGS. 8, 9, 10A and 10B. FIG. 9 is a perspective view illustrating feeding passages for a supply developer and a developer in the image forming apparatus in the second embodiment and shows a state in which the process cartridge is dismounted from the image forming apparatus. FIGS. 10A and 10B are sectional view showing a structure of the developer receiving portion 61 of the image forming apparatus 1 in the second embodiment. FIG. 10A is the sectional view showing a state in which the second developer collecting container 62*b* is mounted in the image forming apparatus, and FIG. 10B is the sectional view showing a state in which the second developer collecting container 62*b* is dismounted from the image forming apparatus. The developer collecting passage is a feeding passage from collecting the developer from the process cartridge 20 to the second developer collecting container 62*b* and is constituted by the developer receiving portion 61.

As shown in FIGS. 9, 10A and 10B, the developer receiving portion 61 includes a developer receiving opening 611 for receiving the developer discharged from the process cartridge 20 and a developer feeding member 613 for feeding the received developer, a developer discharge opening 616 for permitting discharge of the developer into the developer collecting container 62*b*, and a shutter 619 for opening and closing the developer discharge opening 616.

As shown in FIGS. 10A and 10B, a part of the developer receiving opening 611 of the developer receiving portion 61 and a part of the developer feeding member 613 are disposed inside the space 301 (FIG. 7) sandwiched between the pair of frame members 300*a* and 300*b*. On the other hand, the second developer collecting container 62*b* (FIG. 5) are disposed outside the space 301 sandwiched between the pair of frame members 300*a* and 300*b* so as to be mountable and dismountable. That is, the developer receiving portion 61 is provided on the front surface side of the rear surface-side (rear-side) frame member 300*b* of the image forming apparatus 1 and has a constitution in which the developer receiving portion 61 is connected to the second developer collecting container 62*b* which is disposed on the rear side of the frame member 300*b* so as to be mountable to and dismountable from the developer receiving portion 61. Specifically, a constitution in which the developer receiving portion 61 is disposed on the front side of the rear-side frame member 300*b* and is connected to the second developer collecting container 62*b* by penetrating through a through hole of the frame member 300*b* is employed.

The developer feeding member 613 is supported inside the space 301 (FIG. 7) sandwiched between the frame members 300*a* and 300*b* at one end portion thereof in the developer receiving portion 61 and is supported outside the space 301 at the other end portion thereof. A developer discharging portion 614*a* is provided on a side downstream of the developer receiving portion 61 with respect to the developer feeding direction (arrow direction of a broken line in FIG. 9). A developer discharge opening 616 is provided on a most downstream side of the developer discharging portion 614*a* with respect to the developer feeding direction.

The developer feeding member 613 is made of a resin material having a helical shape and is provided rotatably inside the developer receiving portion 61. The developer feeding member 613 is positioned below the developer receiving opening 611 on one end portion side which is a part thereof and is disposed together with the developer receiving opening 611 inside the space 301. On the other hand, the other end portion side of the developer feeding member 613 is positioned above the developer discharge opening 616 and is disposed together with the developer discharge opening 616 outside the space 301. The developer feeding member 613 rotates and feeds the developer received through the developer receiving opening 611, to the developer discharge opening.

As shown in FIGS. 10A and 10B, a shutter 619 is provided slidably (movably) at an outer peripheral portion, of the developer discharging portion 614*a* of the developer receiving portion 61, which is a region positioned outside the space 301 (FIG. 7). The shutter 619 is in a state in which the shutter 619 is urged toward the downstream side of a developer discharging direction by an unshown urging member.

The second developer collecting container 62*b* is constituted so as to be mountable in and dismountable from the image forming apparatus. The second developer collecting container 62*b* is provided with a developer receiving opening 621. In the neighborhood of the developer receiving opening 621, a seal member 622 is provided.

When the second developer collecting container 62*b* is dismounted from the image forming apparatus, the shutter 619 is slid (moved) to a position (shown in FIG. 10B) where the shutter closes the developer discharge opening 616 by an urging force of the urging member.

When the second developer collecting container 62*b* is mounted in the image forming apparatus, the second developer collecting container 62*b* contacts the shutter 619 at a surface thereof to which the seal member 622 is applied, and pushes the shutter 619 in a direction opposite to the developer feeding direction against the urging force of the urging member. When the second developer collecting container 62*b* is mounted in a predetermined position, the developer discharge opening 616 of the developer receiving portion 61 passes through an opening 621 of the second developer collecting container 62*b* and is in a state shown in FIG. 10A in which the developer discharge opening 616 is inserted in an inside space of the second developer collecting container 62*b*.

Accordingly, the developer discharged through the developer discharge opening 214 of the process cartridge 20 is received by the developer receiving portion 61 through the developer receiving opening 611 on the inside of the space 301. The received developer drops on the developer feeding member 613 disposed inside the space 301. The dropped developer is fed form the inside to the outside of the space 301 by rotation of the developer feeding member 613 and is discharged through the developer discharge opening 616 disposed outside the space 301, and then is collected in the second developer collecting container 62*b*. In FIG. 9, broken-line arrows represent feeding directions of the developer collected from the process cartridges into the second developer collecting container 62*b*.

As described above, according to this embodiment, the developer receiving portion 61 for receiving the developer discharged from the process cartridge 20 is disposed inside the space 301 sandwiched between the pair of frame members 300*a* and 300*b*. On the other hand, the second developer collecting container 62*b* for collecting the developer is disposed outside the space 301 sandwiched between the pair of frame members 300*a* and 300*b*. That is, a constitution in which the developer receiving portion 61 is provided on the front surface side of the rear surface-side (rear-side) frame member 300*b* of the image forming apparatus 1 and penetrates through the through hole of the frame member 300*b*, and is connected to the second developer collecting container 62*b* which is disposed on the rear surface side of the frame member 300*b* so as to be mountable to and dismountable from the developer receiving portion 61 is employed.

By employing such a constitution, it becomes possible to not only achieve an effect similar to the effect of the first embodiment but also reduce the number of component parts relating to discharge of the developer.

Other Embodiments

In the above-described embodiments, the image forming apparatus in which the photosensitive unit 25 including the photosensitive member and the developing portion 26 for developing, with the developer, the electrostatic latent image formed on the photosensitive member are integrally assembled into the process cartridge 20 which is made mountable in and dismountable from the image forming apparatus was described as an example. However, the present invention is not limited thereto. Even an image forming apparatus in which the developing portion 26 and the photosensitive unit 25 are prepared as independent units each constituted so as to be mountable in and dismountable from the image forming apparatus can achieve the same effect by applying the present invention thereto.

In the above-described embodiments, a constitution in which the four process cartridges each capable of being mounted in and dismounted from the image forming apparatus was described as an example, but the number of the process cartridges used is not limited thereto and may also be appropriately set as needed.

Further, in the embodiments described above, the printer was described as an example of the image forming apparatus, but the present invention is not limited thereto. For example, other image forming apparatuses such as a copying machine, a facsimile machine and a multi-function machine having functions of these machines in combination may also be used. Further, the image forming apparatus in which the intermediary transfer member is used and on which the toner images of the respective colors are transferred successively and superposedly, and in which the resultant developer images carried on the intermediary transfer member are collectively transferred onto the transfer material was described as an example, but the present invention is not limited thereto. Even an image forming apparatus in which a transfer material carrying member is used and the developer images of the respective colors are successively transferred superposedly onto the transfer material carried on the transfer material carrying member may also be used. By applying the present invention to these image forming apparatuses, effects similar to the effects in the above-described embodiments can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-121496 filed on Jun. 28, 2019, which is hereby incorporated by reference herein in its entirety.

What is claimed is:

1. An image forming apparatus comprising:

a photosensitive unit including a photosensitive member, cleaning means configured to remove a developer from the photosensitive member, and a discharge opening configured to permit discharge of the developer removed from the photosensitive member, the photosensitive unit being mountable in and dismountable from the image forming apparatus;

a pair of frame members provided opposed to each other through a space in which the photosensitive unit is mounted;

a first developer receiving portion connected to the discharge opening of the photosensitive unit and configured to receive the developer discharged through the discharge opening; and a first developer feeding portion connected to the first developer receiving portion and configured to feed the developer received from the first developer receiving portion to a developer collecting portion, wherein the first developer receiving portion is provided inside the space sandwiched between the pair of frame members, wherein the first developer feeding portion is provided outside the space, wherein the developer collecting portion is provided inside the space, wherein the photosensitive unit is mounted and dismounted in a direction of an axis which is a rotation center of the photosensitive member, wherein the pair of frame members is provided on a frame front side and a rear side, respectively, of the photosensitive unit with respect to a mounting direction, and wherein the first developer receiving portion is provided on the frame member provided on the rear side.

2. An image forming apparatus according to claim 1, wherein the first developer receiving portion includes an opening configured to receive the developer discharged through the photosensitive unit and a first developer feeding member configured to feed the received developer to the first developer feeding portion, and wherein the opening and a part of the first developer feeding member are provided inside the space sandwiched between the frame members.

3. An image forming apparatus according to claim 2, wherein the first developer feeding member includes a driving force receiving portion configured to receive a driving force from the first developer feeding portion, and wherein the first developer feeding member is configured to be rotated by reception of the driving force from the first developer feeding portion by the driving force receiving portion.

4. An image forming apparatus according to claim 1, wherein the first developer feeding portion includes a first developer feeding member configured to feed the developer, and wherein the first developer feeding member is connected to a driving gear configured to be rotated by receiving a driving force from a driving source.

5. An image forming apparatus according to claim 4, wherein the first developer feeding member is a feeding member having a helical shape.

6. An image forming apparatus according to claim 1, wherein the image forming apparatus includes a plurality of photosensitive units mountable in and dismountable from the image forming apparatus and includes a plurality of first developer receiving portions corresponding to the photosensitive units, respectively, and wherein each of the first developer receiving portions is connected to a single first developer feeding portion.

7. A image forming apparatus according to claim 1, further comprising a driving portion configured to drive the photosensitive member of the photosensitive unit, wherein the driving portion is provided outside the space sandwiched between the frame members.

8. An image forming apparatus according to claim 1, further comprising, a developer accommodating portion configured to accommodate the developer and a developing portion provided with a receiving opening for receiving the developer supplied from the developer accommodating portion, which are mountable and dismountable from the image forming apparatus, a second developer receiving portion connected to the developer accommodating portion and configured to receive the developer supplied from the developer accommodating portion, a second developer feeding portion connected to the second developer receiving portion and configured to feed the developer received by the second developer receiving portion to the developing portion, and a developer supplying portion connected to the second developer feeding portion and the receiving opening of the developing portion and configured to supply the developer to the developing portion through the receiving opening, wherein the second developer receiving portion, the second developer feeding portion and the developer supplying portion are provided inside the space sandwiched between the frame members.

9. An image forming apparatus according to claim 8, wherein the photosensitive unit and the developing portion are integrally assembled into a process cartridge mountable in and dismountable from the image forming apparatus.

10. An image forming apparatus according to claim 8, wherein the developer accommodating portion is provided below the developing portion with respect to a vertical direction.

11. An image forming apparatus comprising:

a photosensitive unit including a photosensitive member, cleaning means configured to remove a developer from the photosensitive member, and a discharge opening configured to permit discharge of the developer removed from the photosensitive member, the photosensitive unit being mountable in and dismountable from the image forming apparatus;

a pair of frame members provided opposed to each other through a space in which the photosensitive unit is mounted;

a developer receiving portion connected to the discharge opening of the photosensitive unit and configured to receive the developer discharged through the discharge opening; and a developer collecting portion connected to the developer receiving portion and configured to collect the developer received from the developer receiving portion, wherein the developer receiving portion is provided inside the space sandwiched between the frame members, wherein the developer collecting portion is provided outside the space, wherein the photosensitive unit is mounted and dismounted in a direction of an axis which is a rotation center of the photosensitive member, wherein the pair of frame members is provided on a frame front side and a rear side, respectively, of the photosensitive unit with respect to a mounting direction, wherein the developer receiving portion is provided on the frame member provided on the rear side, and wherein when viewed in the direction of the axis, the developer receiving portion and the developer collecting portion partially overlap.

12. An image forming apparatus according to claim 11, wherein the developer receiving portion includes an opening configured to receive the developer discharged through the photosensitive unit and a developer feeding member configured to feed the received developer to the developer accommodating collecting portion, and wherein the opening and a part of the developer feeding member are provided inside the space sandwiched between the frame members.

13. An image forming apparatus according to claim 11, wherein the developer collecting portion is mountable in and dismountable from the image forming apparatus.

14. An image forming apparatus according to claim 12, wherein the developer feeding member is a feeding member having a helical shape.

* * * * *